US011320152B2

(12) United States Patent
Barik et al.

(10) Patent No.: US 11,320,152 B2
(45) Date of Patent: May 3, 2022

(54) COOKTOP WITH HINGED BURNER GRATES

(71) Applicant: WHIRLPOOL CORPORATION, Benton Harbor, MI (US)

(72) Inventors: Deeptiranjan Barik, Maharashtra (IN); Patrick J. Duffy, St. Joseph, MI (US); Tushar Jadhav, Maharashtra (IN); Sachin Karade, Maharashtra (IN); Atul Nalawade, Maharashtra (IN); Pradeep Thorat, Maharashtra (IN)

(73) Assignee: Whirlpool Corporation, Benton Harbor, MI (US)

( * ) Notice: Subject to any disclaimer, the term of this patent is extended or adjusted under 35 U.S.C. 154(b) by 174 days.

(21) Appl. No.: 16/670,091

(22) Filed: Oct. 31, 2019

(65) Prior Publication Data

US 2021/0131673 A1 May 6, 2021

(51) Int. Cl.
*F24C 15/08* (2006.01)
*F24C 15/10* (2006.01)

(52) U.S. Cl.
CPC ..... *F24C 15/107* (2013.01); *F24C 15/08* (2013.01); *F24C 15/10* (2013.01)

(58) Field of Classification Search
CPC ..... F24C 15/08; F24C 15/107; F24C 15/10; A47J 37/041; A47J 37/0704; A47J 37/0623; A47J 37/0786; A47J 2037/0795
See application file for complete search history.

(56) References Cited

U.S. PATENT DOCUMENTS

| | | | |
|---|---|---|---|
| 416,068 | A | 11/1889 | Muller |
| 996,322 | A | 6/1911 | Edwards |
| 1,263,203 | A | 4/1918 | Burnett |
| 1,385,541 | A | 7/1921 | Hammer |
| 1,539,276 | A | 5/1925 | Savage |
| 2,066,507 | A | 1/1937 | Yost |
| 2,200,016 | A | 5/1940 | Althoff |
| 2,528,333 | A | 10/1950 | Biddle et al. |
| 2,823,657 | A | 2/1958 | Brodbeck |
| 3,632,982 | A | 1/1972 | Linger et al. |
| 3,797,375 | A | 3/1974 | Cerola |
| 4,206,345 | A | 6/1980 | Maass et al. |
| 4,390,114 | A | 6/1983 | Sviatoslavsky et al. |
| 4,517,955 | A | 5/1985 | Ehrlich et al. |
| 4,869,231 | A | 9/1989 | Rice et al. |
| 4,930,491 | A | 6/1990 | Purello |
| 5,743,173 | A | 4/1998 | Hayashi et al. |

(Continued)

FOREIGN PATENT DOCUMENTS

| | | | |
|---|---|---|---|
| DE | 10126935 | A1 | 12/2002 |
| EP | 505806 | A1 | 9/1992 |

(Continued)

*Primary Examiner* — Alfred Basichas
(74) *Attorney, Agent, or Firm* — Price Heneveld LLP

(57) ABSTRACT

A cooktop for an appliance includes a cooktop base surface that defines an edge. A cooktop burner is mounted on the cooktop base surface. A support base is rigidly fixed with the cooktop base surface adjacent the edge. A grate is rotatably supported to the support base and is rotatable between a raised position and a lowered position to alternately cover and uncover the cooking burner. A biasing member is coupled to the support base and exerts an upward biasing force on the grate.

20 Claims, 13 Drawing Sheets

(56) References Cited

U.S. PATENT DOCUMENTS

| | | | | |
|---|---|---|---|---|
| 5,793,021 | A | 8/1998 | Walton | |
| 6,271,504 | B1 | 8/2001 | Barritt | |
| 6,371,105 | B1 | 4/2002 | Merritt | |
| 8,147,015 | B2 | 4/2012 | Kim et al. | |
| 8,910,622 | B2 | 12/2014 | Mishra et al. | |
| 9,861,230 | B2 | 1/2018 | Freymiller et al. | |
| 9,903,593 | B2 | 2/2018 | Breneman et al. | |
| 10,113,748 | B2 | 10/2018 | Braden et al. | |
| 10,598,389 | B2 * | 3/2020 | Cowan | F24C 3/027 |
| 2011/0067577 | A1 | 3/2011 | Riddle et al. | |
| 2011/0114077 | A1 | 5/2011 | Mishra et al. | |
| 2015/0257592 | A1 | 9/2015 | Garman et al. | |
| 2018/0180294 | A1 | 6/2018 | Breneman et al. | |
| 2018/0245799 | A1 | 8/2018 | Billman et al. | |
| 2018/0356101 | A1 | 12/2018 | Lee et al. | |
| 2019/0383497 | A1 | 12/2019 | Cowan et al. | |

FOREIGN PATENT DOCUMENTS

| | | | |
|---|---|---|---|
| EP | 2501997 | B1 | 3/2016 |
| EP | 2341294 | B1 | 2/2017 |
| EP | 2792954 | B1 | 3/2017 |
| JP | S6078227 | A | 5/1985 |
| JP | S6078228 | A | 5/1985 |

* cited by examiner

COOKTOP WITH HINGED BURNER GRATES

BACKGROUND OF THE DISCLOSURE

The present disclosure generally relates to a cooktop assembly, and more specifically, to a cooktop assembly including grates hingedly supported over associated burners.

SUMMARY OF THE DISCLOSURE

According to one aspect of the present disclosure, a cooktop for an appliance includes a cooktop base surface that defines an edge. A cooking burner is mounted on the cooktop surface. A support base is rigidly fixed with the cooktop base surface adjacent to the edge. The grate rotatably supported by the first and second support bases and is rotated between a raised position and a lowered position to alternately cover and uncovered the cooking burner. A biasing member is coupled to the support base. A biasing member is coupled to the first support base and exerts an upward biasing force on the grate.

According to another aspect of the present disclosure, a cooktop for an appliance includes a cooktop surface that defines an edge. A first support base is rigidly fixed with the cooktop surface adjacent to the edge. A pivot member is coupled to the first support base. A second support base is rigidly fixed with the cooktop surface adjacent the first support base. A biasing assembly includes a first housing, a second housing, and a biasing member disposed therebetween. The biasing assembly is coupled to the second support base. A grate is coupled to the pivot member and the biasing assembly. The grate is rotatable between raised and lowered positions and biased toward the raised position by the biasing assembly.

According to yet another aspect of the present disclosure, a cooktop assembly includes a cooktop base surface that defines an edge. A grate is operably coupled to the cooktop surface. The grate defines a first receiving member that has a first channel and a second receiving member that has a second channel. A first support base is coupled to the cooktop base surface proximate the edge. A pivot member is coupled to the first support base and at least partially received within the first channel. A second support bases coupled to the second base surface proximate the edge. A biasing assembly is coupled to the second support base and received within the second channel and biasing the grate toward a raised position.

These and other features, advantages, and objects of the present disclosure will be further understood and appreciated by those skilled in the art by reference to the following specification, claims, and appended drawings.

Figure 1:
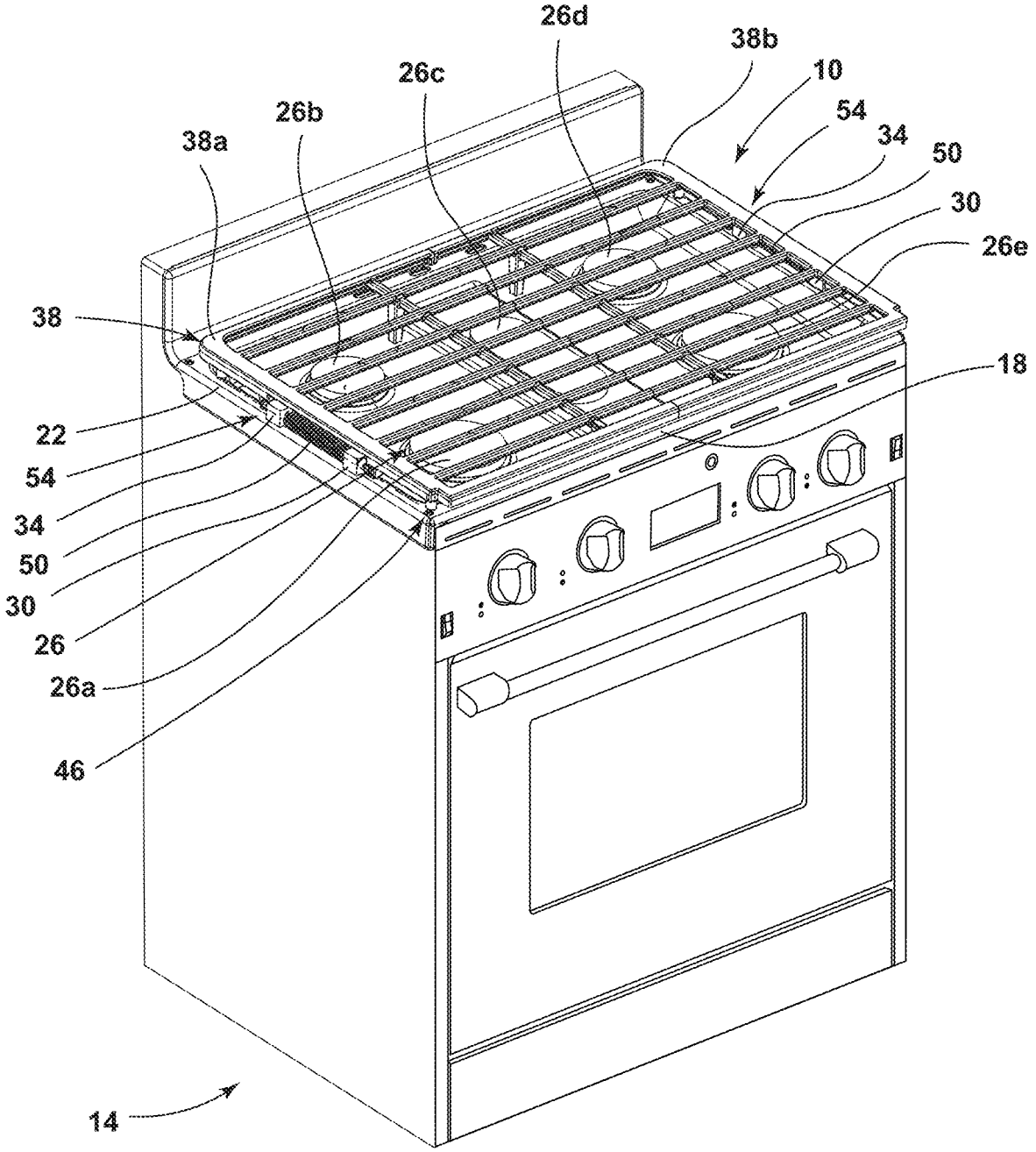
FIG. 1 a front perspective view of a cooking appliance, according to an aspect of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a cooktop with hinged burner grates. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-13A, reference numeral 10 generally refers to a cooktop for an appliance 14 that includes a cooktop base surface 18 defining an edge 22. A cooking burner 26 is mounted on the cooktop base surface 18. A first support base 30 is rigidly fixed with the cooktop base surface 18 adjacent to the edge 22. A second support base 34 is rigidly fixed with the cooktop base surface 18 adjacent to the first support base 30. A grate 38 is rotatably supported the first and second support bases 30, 34 and is rotatable between a raised position 42 and a lowered position 46 to alternately cover and uncover the cooking burner 26. A biasing member 50 is coupled to at least one of the first and second support bases 30, 34 and exerts an upward biasing force on the grate 38.

The appliance 14 is shown in the form of a range that includes the cooktop 10 and an oven in a single unit, but may also be in the form of a stand-alone cooking hob or the like. The appliance 14 can be generally similar to known cooking appliances, including the construction and arrangement of the above-mentioned cooking burner 26. The cooking burner 26 may be one cooking burner 26*a* of a multi-burner arrangement. The appliance 14 of FIG. 1 is illustrated including a five-burner arrangement, including additional cooking burners 26*b*-26*e*. As used herein, the multi-burner arrangement 26*a*-26*e* is referred to using the general reference number 26, unless a specific burner is discussed. The cooking burners 26 can be of any type that may be used in connection with the grate 38 positioned thereon to support a cooking article, such as a pan, a pot, or the like, above and/or spaced-apart from the cooking burner 26 with which it is used. In general, fuel-burning burners (e.g., those that rely on combustion of natural or propane gas for the generation of heat) are used with the grate 38, and may be used in connection with the appliance 14 that has the cooking burners 26, as discussed herein. Numerous types and configurations of the cooking burner 26 that are known or may be developed may be used, including various types of "hybrid" burners, which may generate heat by multiple means, including fuel-burning and/or electrical heating.

Additionally, the cooktop base surface 18 may be similar to known structures for similar components of a cooking appliance 14 and may be of any structure that can sufficiently support the grate 38 and is amenable to the coupling of the first and second support bases 30, 34 thereto. The first and second support bases 30, 34 may be coupled to the cooktop base surface 18 using mechanical fasteners, such as screws, rivets, or the like. The first and second support bases 30, 34 may further incorporate various alignment features, according to various known principles. In this manner, the cooktop base surface 18 may be generally structured to provide support and a location for the cooking burners 26 and may conceal the various lines and controls associated with the cooking burners 26, as well as, to support the grate 38 over the cooking burners 26. In many aspects, the cooktop base surface 18 may be a metal sheet stamped, or otherwise formed into the selected three-dimensional shape. Such metal may be steel, stainless steel, aluminum, or the like, and may be a gauge high enough to provide structural stability, given the particular material characteristics, without unnecessarily increasing weight or difficulty of the manufacture thereof.

Figure 2:
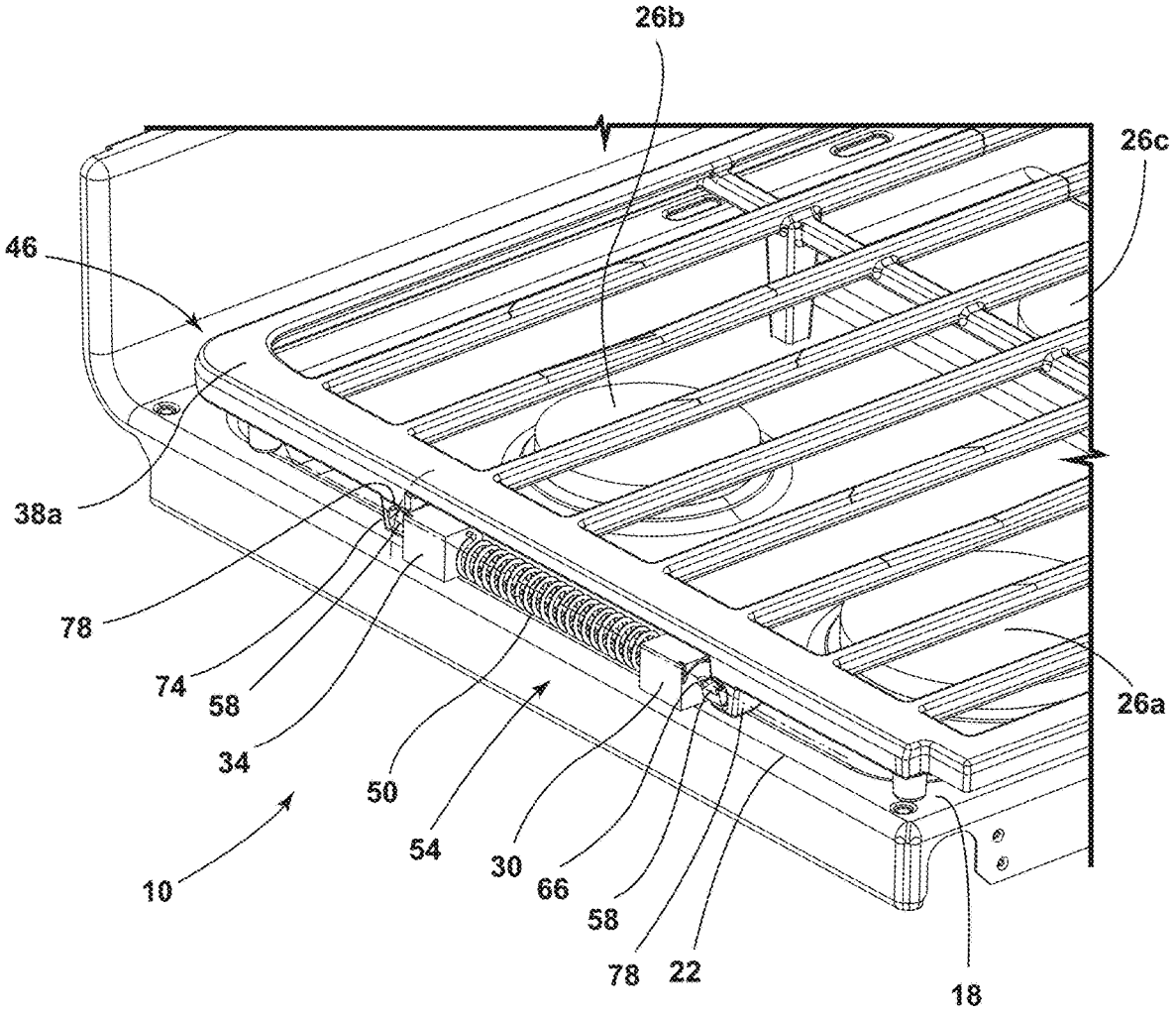
FIG. 2 is a perspective detail view of a support base and corresponding interface with a grate associated with a cooktop.
Figure 3:
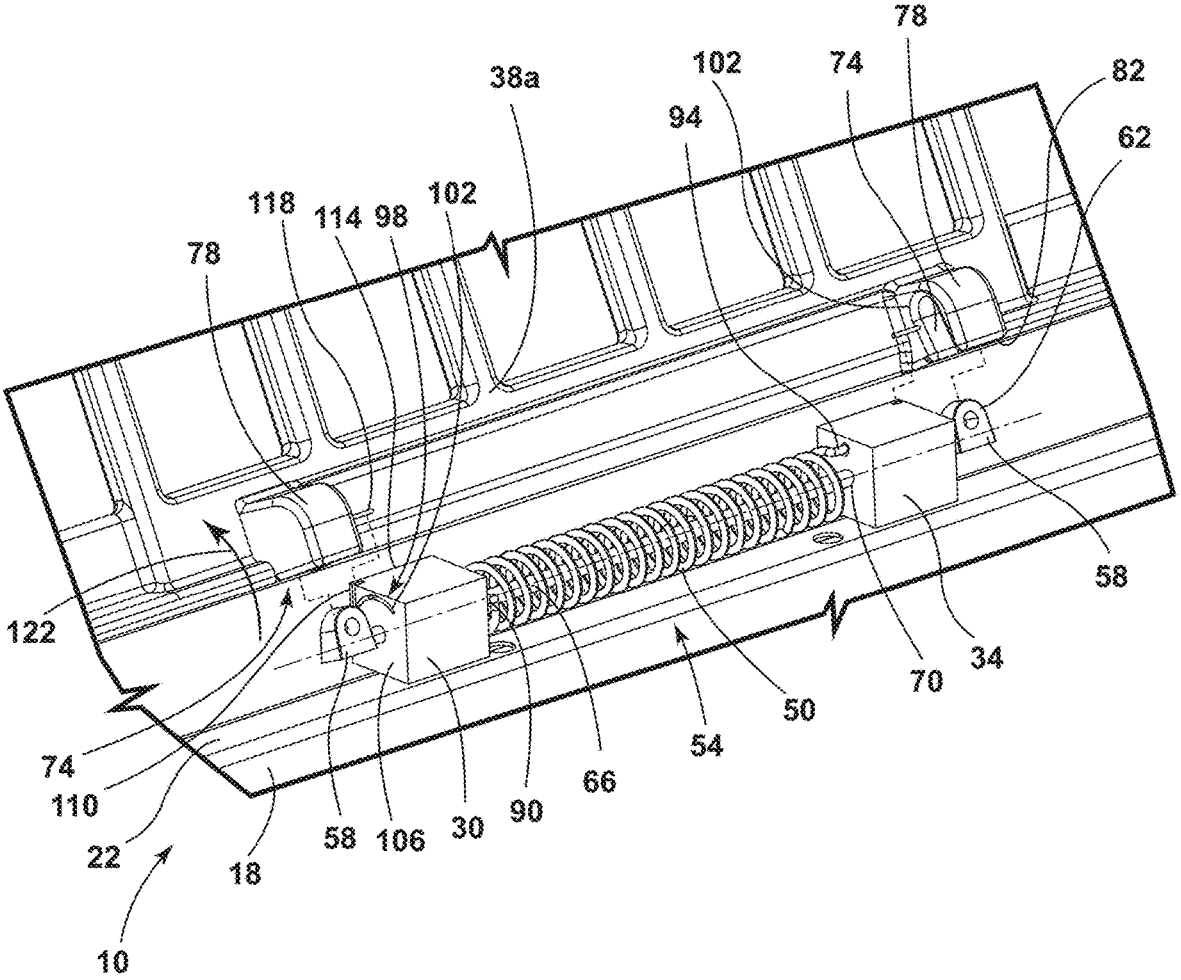
FIG. 3 is a perspective detail assembly view of a support assembly and corresponding interface with a grate.

Referring to FIGS. 1-3, the first and second support bases 30, 34 may be rigidly fixed to the cooktop base surface 18. The first and second support bases 30, 34 may be directly coupled to the cooktop base surface 18, or alternatively, may be coupled with a base plate or a similar feature. In various examples, the first and second support bases 30, 34 may be included in a support base assembly 54, which may be coupled to the cooking base surface 18. The first and second support bases 30, 34 may be coupled to the cooktop base surface 18 proximate the edge 22. As illustrated in FIGS. 1-3, the edge 22 may be a side edge of the cooktop base surface 18. However, it is also contemplated that the support base assembly 54 may be disposed proximate a rear edge or a front edge of the cooktop base surface 18, without departing from the teachings herein.

As best illustrated in FIG. 3, the first and second support bases 30, 34 may each include a mounting projection tab 58. The mounting projection tabs 58 may extend outwardly from the first and second support bases 30, 34, respectively, away from one another. The mounting projection tabs 58 may be generally wedged-shaped having a rounded end 62. The mounting projection tabs 58 may be mounted on an axle 66 that is rotatably supported by the first and second support bases 30, 34. In this way, the axle 66 may rotatably couple the mounting projection tabs 58 to the first and second support bases 30, 34. Stated differently, the mounting projection tabs 58 may be rotatably coupled with the first and second support bases 30, 34 by the axle 66. According to various aspects, the axle 66 may extend from one of the mounting projection tabs 58, which may be rigidly coupled to the axle 66, through a hole 70 in the first support base 30. Similarly, the axle 66 may extend from the other of the mounting projection tabs 58 through the hole 70 defined by the second support base 34. In this way, the axle 66 may extend between the first and second support bases 30, 34. The axle 66 may be rotatably received within the holes 70 of the first and second support bases 30, 34 to support the mounting projection tabs 58 and facilitate rotation thereof.

Figure 6:
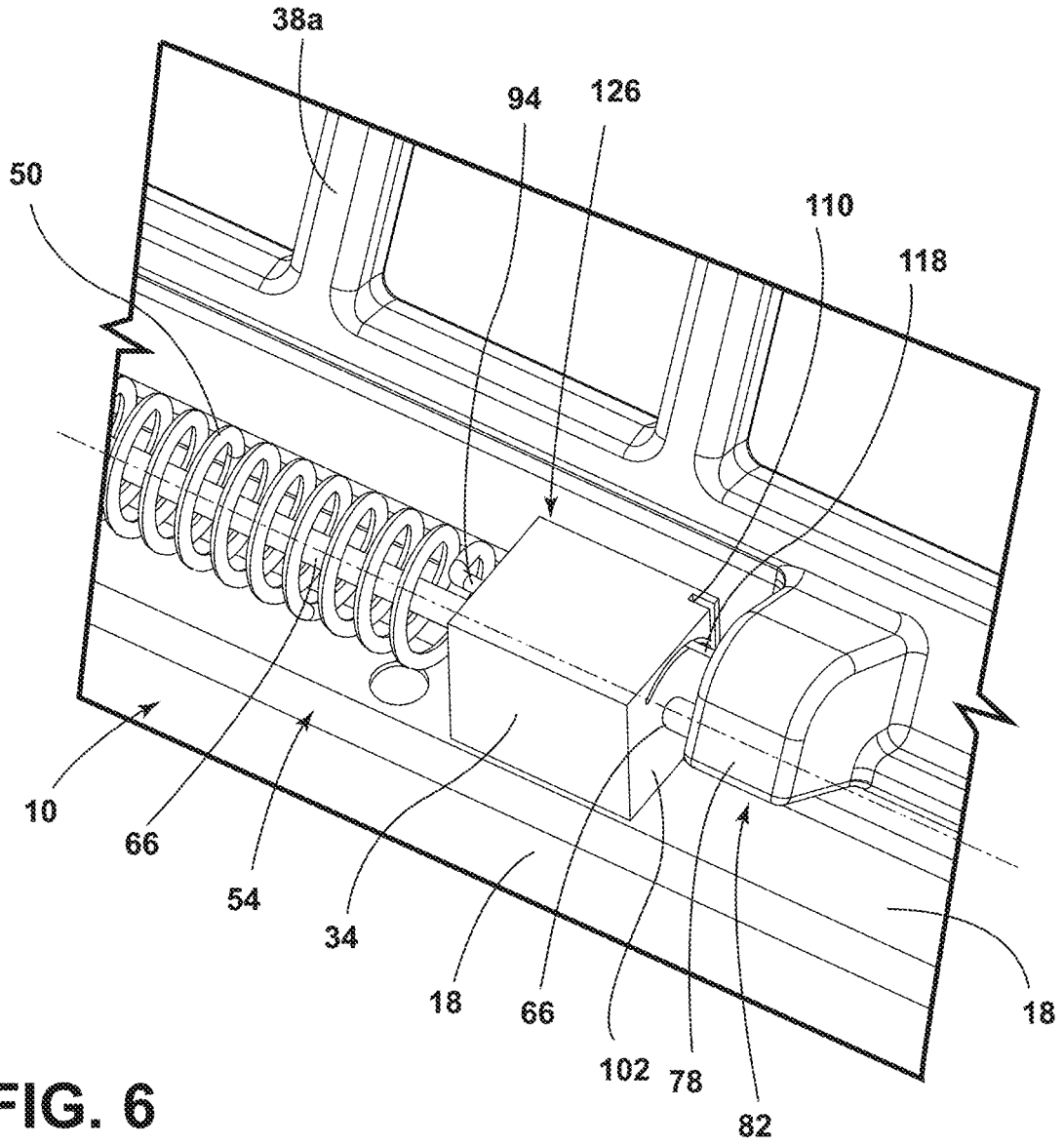
FIG. 6 is a detail view of a retention track and a pin associated with a support assembly and a grate.
Figure 7:
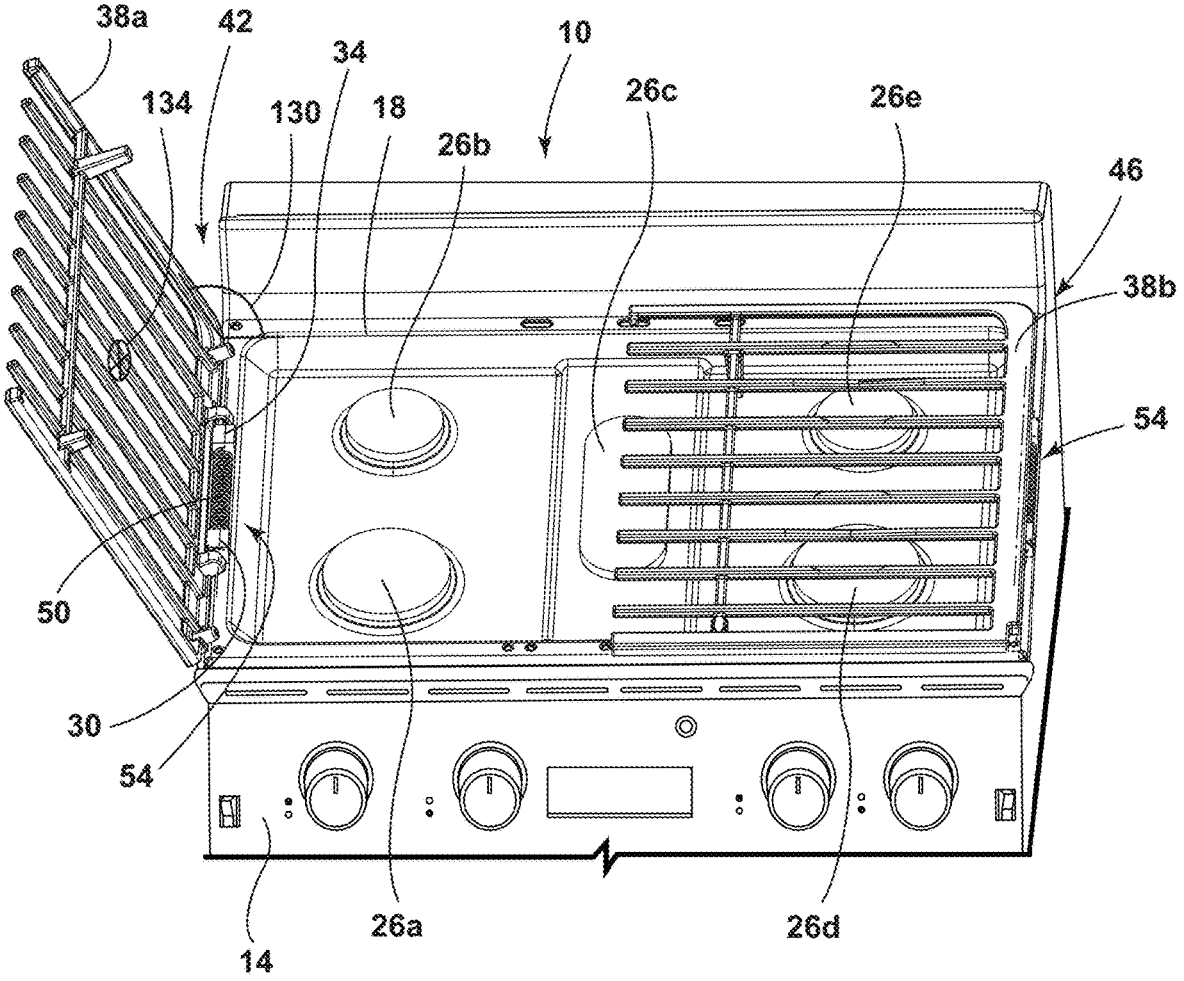
FIG. 7 is a perspective view of a cooktop of a grate in a further rotated position about a support assembly.

The orientation and configuration of the mounting projection tabs 58 may provide support for the grate 38 during rotation thereof from the lowered position 46, illustrated in FIG. 1, where the grate 38 is disposed towards and is generally parallel with the cooktop base surface 18 and overlies the cooking burner 26, to the raised position 42, as illustrated in FIGS. 6 and 7. As illustrated, the grate 38 may extend along the entirety of the edge 22 and extending inwardly therefrom to cover at least approximately half of the cooktop base surface 18 when in the lowered position 46. In this manner, the grate 38 may extend over the front left burner 26*a* and the rear left cooking burner 26*b*, as well as approximately half of a central cooking burner 26*c*. It is noted that the size of the grate 38 can be configured to cover multiple cooking burners 26, or portions thereof, according to other burner arrangements according to the principles and concepts discussed herein. This arrangement, as presently described, can allow for easy access to portions of the cooktop base surface 18 underlying the grate 38, as well as the cooking burners 26, specifically for cleaning or service.

In various examples, the appliance 14 includes a first grate 38*a* and a second grate 38*b*, which may be referred to using the general reference number 38, unless a specific one of the first and second grates 38*a*, 38*b* is discussed. Each of the first and second grates 38*a*, 38*b* may be coupled to the cooktop base surface 18 by the support base assembly 54. Stated differently, the first grate 38*a* may be coupled to the support base assembly 54 and the second grate 38*b* may be coupled to an additional support base assembly 54. The first and second grates 38*a*, 38*b* may be substantially mirror images of one another. In various examples, the first grate 38*a* may cover the front left cooking burner 26*a* and the rear left cooking burner 26*b*. Similarly, the second grate 38*b* may extend over the front right cooking burner 26*d* and the rear right cooking burner 26*e*. In examples of appliance 14 including the central cooking burner 26*c*, each of the first and second grates 38*a*, 38*b* may extend over a portion of the central cooking burner 26*c*. However, it is contemplated that the cooktop 10 may not include the central cooking burner 26*c*. In such examples, the cooking burners 26 may be arranged in a four-burner configuration with each of the first and second grates 38*a*, 38*b* are disposed over two cooking burners 26 when in the lowered position 46.

According to various aspects, the grate 38 may be made of cast iron or another material with high heat resistance and high weight-bearing (including at temperature). The ability to rotate the grate 38, rather than having to lift the grate 38 out of position and to properly align the grate 38 while holding and lowering it into position, may prove to be advantageous. Further, when typical grates are removed for cleaning or the like, the grates 38 must be stored or otherwise placed somewhere other than on the cooktop base surface 18, which may be inconvenient. As discussed further below, the ability of the present cooktop 10 to retain the grate 38 when rotated upwardly to the raised position 42 may provide an easy alternative to separate storage of the grate 38 to move away from the cooktop base surface 18 and the cooking burners 26.

As illustrated in FIGS. 2 and 3, the grate 38 is configured to assemble with the first and second support bases 30, 34, by including a slot 74 extending inwardly relative to a portion of the grate 38. In particular, the slot 74 may be defined within a corresponding projection 78 that extends from a lower surface of the grate 38. The projection 78 may define an outer face 82 that may be disposed generally towards the edge 22 of the cooktop base surface 18 and an inside face 86 that may be disposed towards one of the first and second support bases 30, 34, when the grate 38 is assembled on the support base assembly 54. The slot 74 may extend inwardly from both the outer face 82 and the inside face 86, such that the slot 74 is enclosed on the remaining four sides thereof. In this manner, the slot 74 can closely receive the corresponding mounting projection tab 58 therein. In this way, the slot 74 and the mounting projection tab 58 support the grate 38 during the rotation thereof. Additionally or alternatively, the mounting projection tabs 58 may rotate with the grate 38 by way of the engagement between the slot 74 and the mounting projection tabs 58. Stated differently, the projections 78 are engageable over mounting projection tabs 58. This configuration where the slots 74 are opened on the inside face 86 may allow for the axle 66 to extend into the slots 74 to couple the mounting projection tabs 58.

As shown in FIG. 3, the slots 74 may disengage from the mounting projection tabs 58 by movement of the grate 38. During such movement, the slots 74 may move relative to the mounting projection tabs 58 with the outer faces 82 of the projections 78 passing over the mounting projection tabs 58. As can be appreciated, the movement of the slot 74 from off of the mounting projection tab 58 may correspond with removal of the grate 38 from the support base assembly 54. In this manner, the grate 38 can be completely removed from the support base assembly 54 and, therefore, the remainder of the appliance 14, such as for cleaning of the grate 38, or to facilitate upward rotation of the cooktop base surface 18 (e.g., for access to components therebeneath). The above-described wedge shape of the mounting projection tabs 58 can help to maintain a close fit with the slots 74 when in the assembled position, as shown in FIG. 2, while minimizing the effect of mutual friction between components during removal of the grate 38.

As illustrated in FIGS. 1-3, the support base assembly 54 may further include the biasing member 50 coupled between the axle 66 and at least one of the first and second support bases 30, 34. In particular, the biasing member 50 may be a coil spring with the axle 66 extending therethrough. As illustrated, a first end 90 of the biasing member 50 may be coupled with the first support base 30, such as by extending partially therein, and a second end 94 may be coupled to the axle 66, such as by welding, mutual engagement, adhesives, and/or combinations thereof, or the like. By this arrangement, the biasing member 50 may compress and extend torsionally with rotation of the mounting projection tabs 58, and correspondingly with the grate 38.

According to various aspects, the biasing member 50 may be coupled between the first support base 30 and the axle 66 so as to torsionally compress under rotation of the grate 38 towards the cooktop base surface 18 (i.e., from the position shown in FIG. 7 to the position shown in FIGS. 1 and 2). In this manner, the biasing member 50 may exert a rotational force on the axle 66 when the grate 38 is in the lowered position 46 of FIGS. 1 and 2, which can be controlled such that the rotational force of the biasing member 50 does not interfere with the grate 38 securely resting in the lowered position 46, but provides an upward biasing force on the grate 38. The upward biasing force, by way of the engagement between the mounting projection tabs 58 in the slots 74, may assist a user in rotating the grate 38 into the raised position 42.

In various examples, force on the axle 66 by the biasing member 50 may still be present on the grate 38 in the raised position 42, or alternatively, the biasing force may reduce to about zero with movement of the grate 38 into the raised position 42, depending on the configuration of the biasing member 50. The characteristics of the biasing member 50 may be adjusted to achieve the desired biasing force and the level of assistance in lifting the grate 38 by known principles given, for example, the weight of the grate 38 and the angle through which the grate 38 rotates from the lowered position 46 to the raised position 42. Further, it is also contemplated that the biasing member 50 may be, for example, a spring, a clock spring, magnets, or other features producing a biasing force. Moreover, it is also contemplated that the biasing member 50 may be coupled between the second support base 34 and the axle 66, or alternatively, between the first and second support bases 30, 34.

Referring again to FIGS. 1-3, the support base assembly 54 may include the first support base 30 and the second support base 34. The first and second support bases 30, 34 may have similar configurations and may be mirror images of one another. The second support base 34 may be spaced-apart from the first support base 30 along the edge 22 of the cooktop base surface 18. Each of the first and second support bases 30, 34 may include a respective mounting projection tab 58 configured to cooperate with the corresponding slot 74 of the grate 38. In this manner, the grate 38 may be removably coupled with the mounting projection tabs 58 of both the first and second support bases 30, 34. Use of both the first and second support bases 30, 34, each with the mounting projection tab 58 engaging the corresponding slot 74 of the respective projection 78, may provide for increased balancing and stability of the grate 38 during rotation and once positioned in the raised position 42 (FIG. 7). Further, the opposing arrangement of the slots 74 may help to locate and maintain the grate 38 in place with respect to the support base assembly 54.

Figure 4:
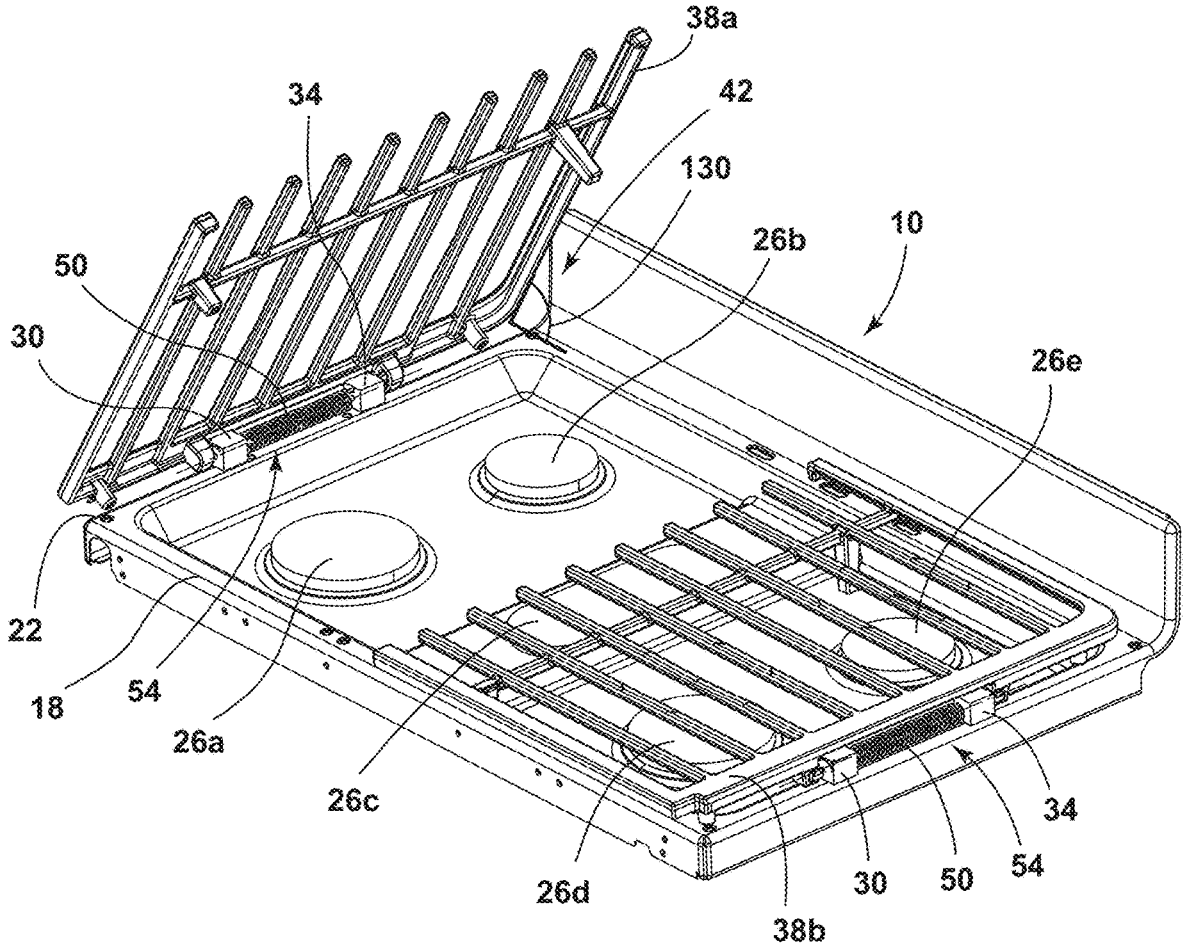
FIG. 4 is a perspective view of a cooktop with a grate in a rotated position about a support assembly.
Figure 5:
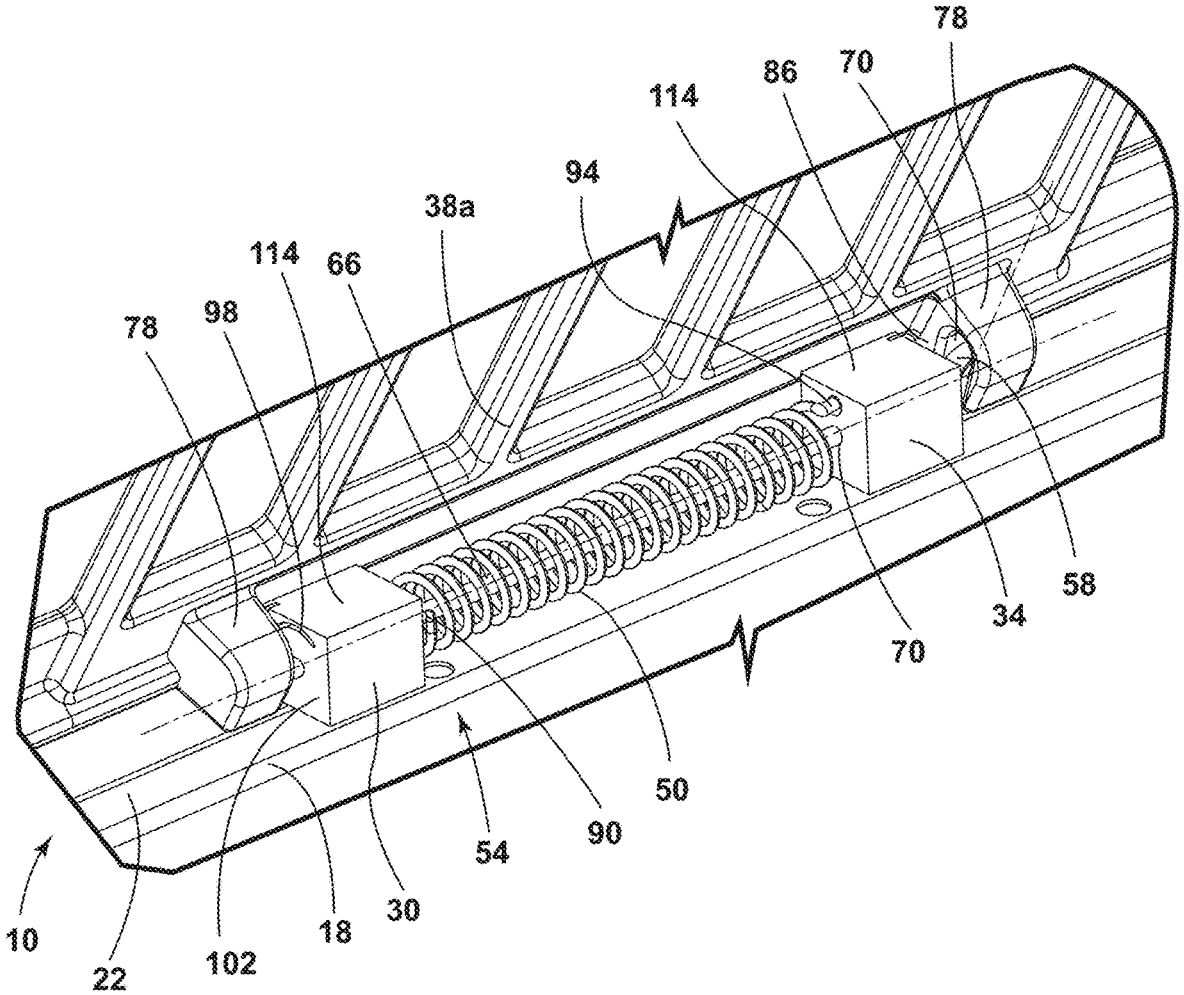
FIG. 5 is a perspective detail view of a portion of a grate in a rotated position about a support assembly.

Referring now to FIGS. 4-6, the first and second support bases 30, 34 may each define a retention track 98 in an inwardly-facing surface 102 of each of the first and second support bases 30, 34. The retention tracks 98 may each include a closed portion 106 that extends in an arcuate manner and an open portion 110 that extends linearly in a substantially vertical manner from an end of the closed portion 106 to an upper surface 114 of the respective first and second support bases 30, 34. The grate 38 includes pins 118 extending from the inside face 86 of each respective projection 78. In particular, the pins 118 may be sized and positioned to fit within the retention tracks 98 and, more particularly, to travel within the closed portions 106 of the retention tracks 98 during rotation of the grate 38. In this manner, the engagement between the pins 118 and the closed portions 106 of the respective retention tracks 98 may restrict movement of the grate 38 to prevent disengagement of the grate 38 from the support base assembly 54.

As illustrated in FIGS. 4 and 5, the configuration of the closed portion 106 and the open portions 110 with respect to the closed portion 106 is such that the pin 118 is within the closed portions 106 when the grate 38 is in the lowered position 46 and during rotation of the grate 38 upwardly towards the raised position 42. This arrangement may be advantageous to prevent inadvertent removal of the grate 38 during the rotation of the grate 38. When the grate 38 is fully in the raised position 42, shown in FIGS. 6 and 7, the pins 118 align with the open portions 110 of the retention tracks 98. Movement of the grate 38 in direction 122 moves the pins 118 out of the closed portion 106, through the open portion 110, and past the upper surface 114 to disengage from the first and second support bases 30, 34. This movement coincides with the movement of the slots 74 out of the engagement over the respective mounting projection tabs 58. The grate 38 can be re-assembled with the support base assembly 54 by alignment of the slots 74 with the respective mounting projection tabs 58 and alignment of the pins 118 with the open portion 110 of the retention tracks 98 and movement opposite the direction 122, at which point, the grate 38 can be rotated.

As illustrated in FIGS. 6 and 7, a blocking surface 126 of the grate 38 may extend along the edge thereof between the projections 78. The blocking surface 126 may be spaced from the upper surfaces 114 of the first and second support bases 30, 34 to be away from when the grate 38 is in the lowered position 46, and during rotation of the grate 38 upwardly away therefrom. When the grate 38 reaches the raised position 42, including by rotation of the grate 38 through a predetermined angle 130 corresponding with the raised position 42, the blocking surface 126 may contact with the upper surfaces 114, such that further rotation of the grate 38 past the angle 130 is prevented.

Figure 8:
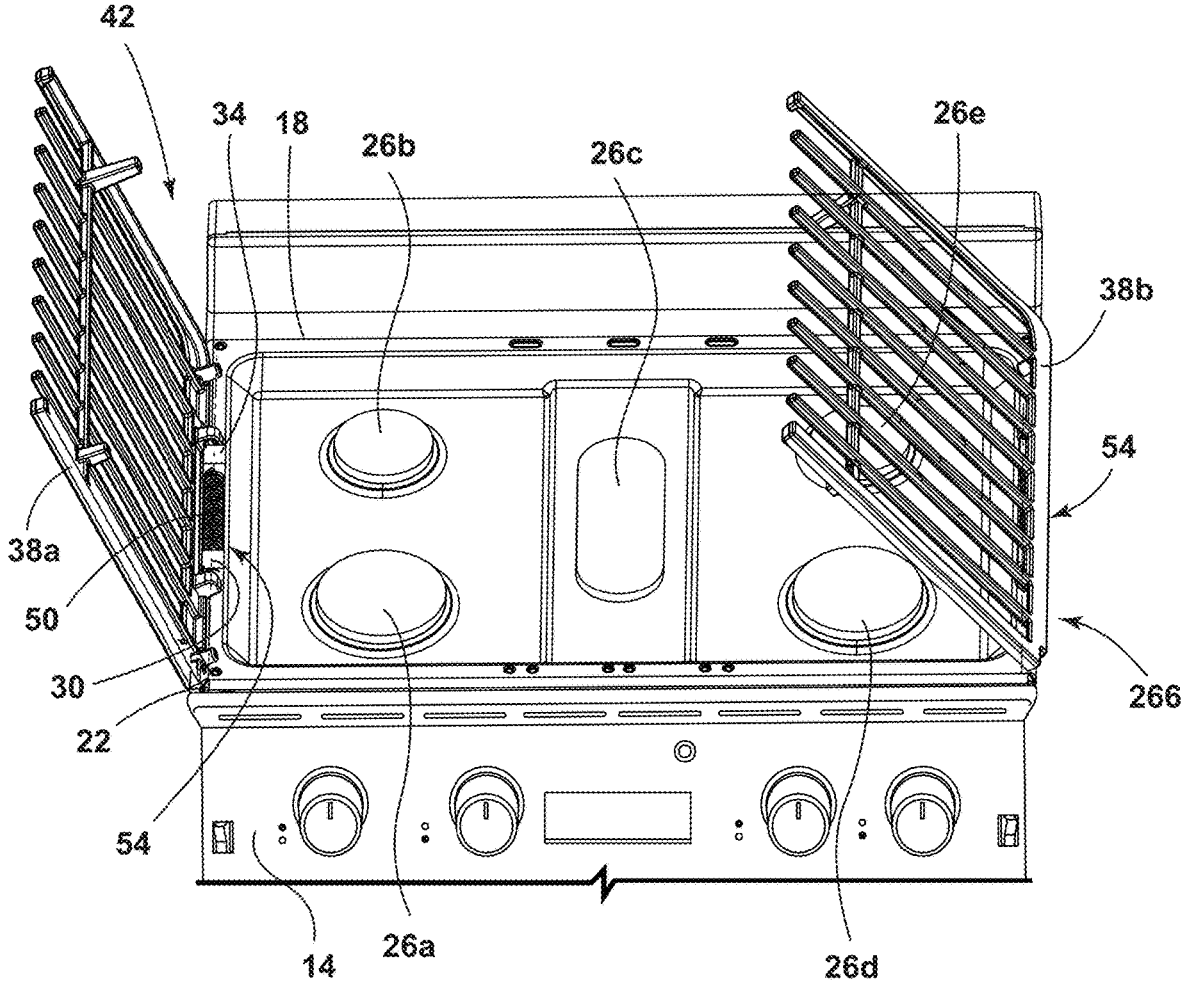
FIG. 8 is a perspective view of a cooktop of the second grate in a rotated position about an additional support assembly.

As illustrated in FIGS. 7 and 8, when the predetermined angle 130 is greater than 90°, such as an angle between about 100° and about 115°, for example, the center of mass 134 of the grate 38 may be positioned such that the weight of the grate 38 is oriented in a general direction of increasing rotation of the grate 38. The increasing rotation may be prevented by contact between the blocking surface 126 and the upper surfaces 114 of the first and second support bases 30, 34. This configuration may maintain the grate 38 in the fully raised position 42 until deliberately moved toward the lowered position 46 by a user. It is noted that a damper can be incorporated between the axle 66 and either or both of the first and second support bases 30, 34 to prevent rapid downward movement of the grate 38 into the lowered position 46 under the weight of the grate 38.

Referring now to FIGS. 9-12, an additional and/or alternative configuration of the cooktop 210 is illustrated (with similar features indicated by similar numbers increased by 200). In this example, the cooking burners 226 are arranged in a four-burner configuration including the cooking burners 226*a*-226*d*. The first grate 238*a* may be disposed over the cooking burners 226*a*, 226*b*, and the second grate 238*b* may be positioned over the cooking burners 226*c*, 226*d* when in the lowered positions 246. The grate 238 may be operable between the raised position 242 and the lowered position 246 to alternately cover and uncover the cooking burners 226. The first support base 230 may be rigidly fixed to the cooktop base surface 218 adjacent to the edge 222. The second support base 234 may be rigidly fixed with the cooktop base surface 218 adjacent to the first support base 230. In this way, the first and second support bases 230, 234 may be spaced-apart from one another and disposed proximate to the edge 222 of the cooktop base surface 218.

Figure 9:
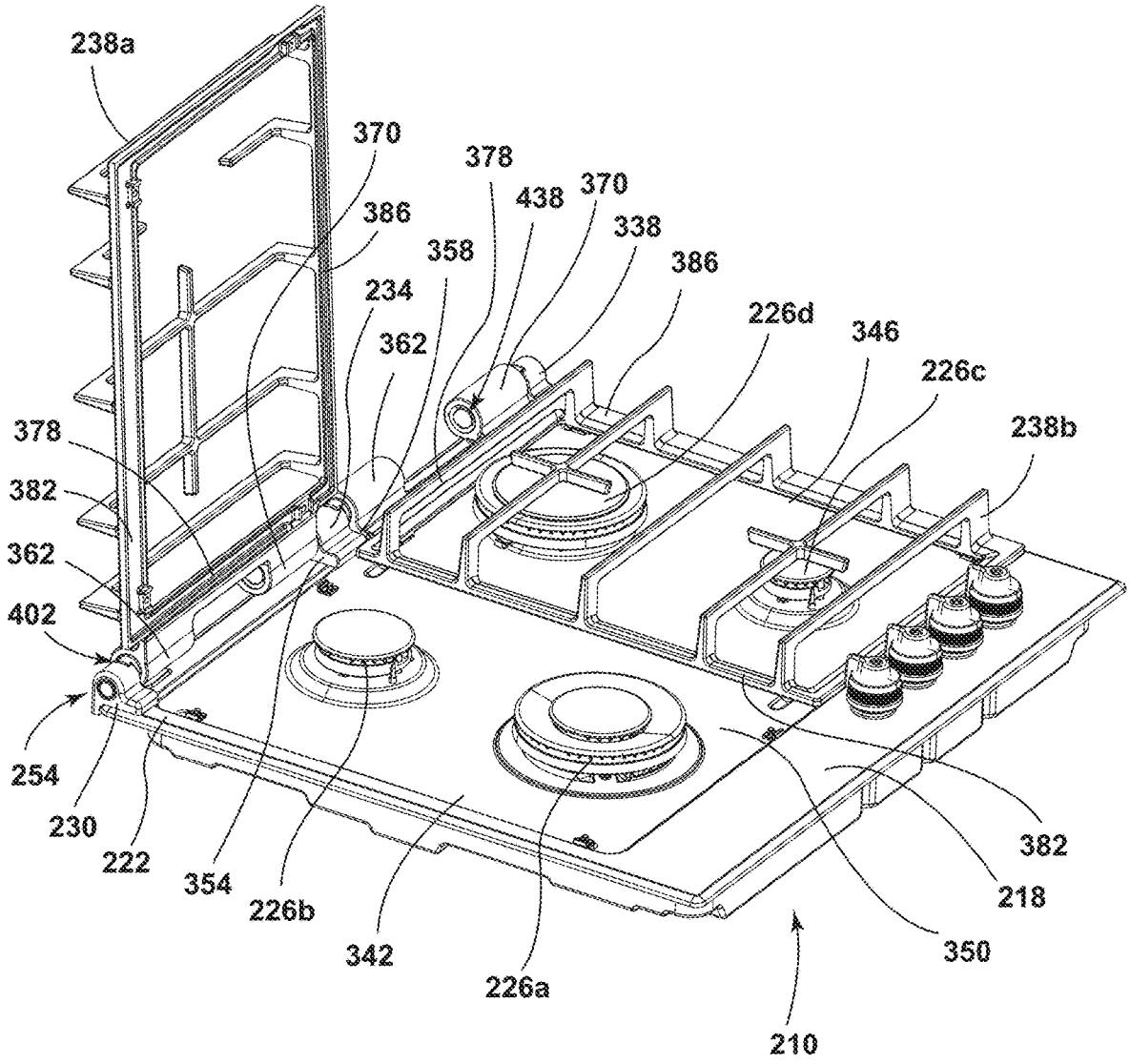
FIG. 9 is a perspective view of a cooktop, according to an aspect of the present disclosure.

As illustrated in FIG. 9, first and second support bases 230, 234 of a support base assembly 254 are disposed proximate a rear edge of a cooktop base surface 218; however, the first and second support bases 230, 234 may be disposed proximate a side edge or front edge of the cooktop base surface 218, without departing from the teachings herein. In various examples, a cooktop 210 may include a third support base 338 disposed proximate to the second support base 234 along an edge 222. Stated differently, the cooktop 210 may include the first support base 230 disposed proximate a first portion 342 of the cooktop base surface 218, the third support base 338 disposed proximate a second portion 346, and the second support base 234 disposed therebetween proximate a center portion 350 of the cooktop base surface 218. In this way, a first grate 238*a* may be rotatably supported by the first and second support bases 230, 234 and the second grate 238*b* may be rotatably supported by the second and third support bases 224, 338. Moreover, the second support base 234 may be coupled to both the first and second grates 238*a*, 238*b*. The first grate 238*a* may be coupled to a first side 354 of the second support base 234 and the second grate 238*b* may be coupled to a second side 358 of the second support base 234 opposing the first side 354. It is noted that fewer or more support bases may be included in the support base assembly 254 based on the number of grates 238 associated with the cooktop 210.

Figure 10:
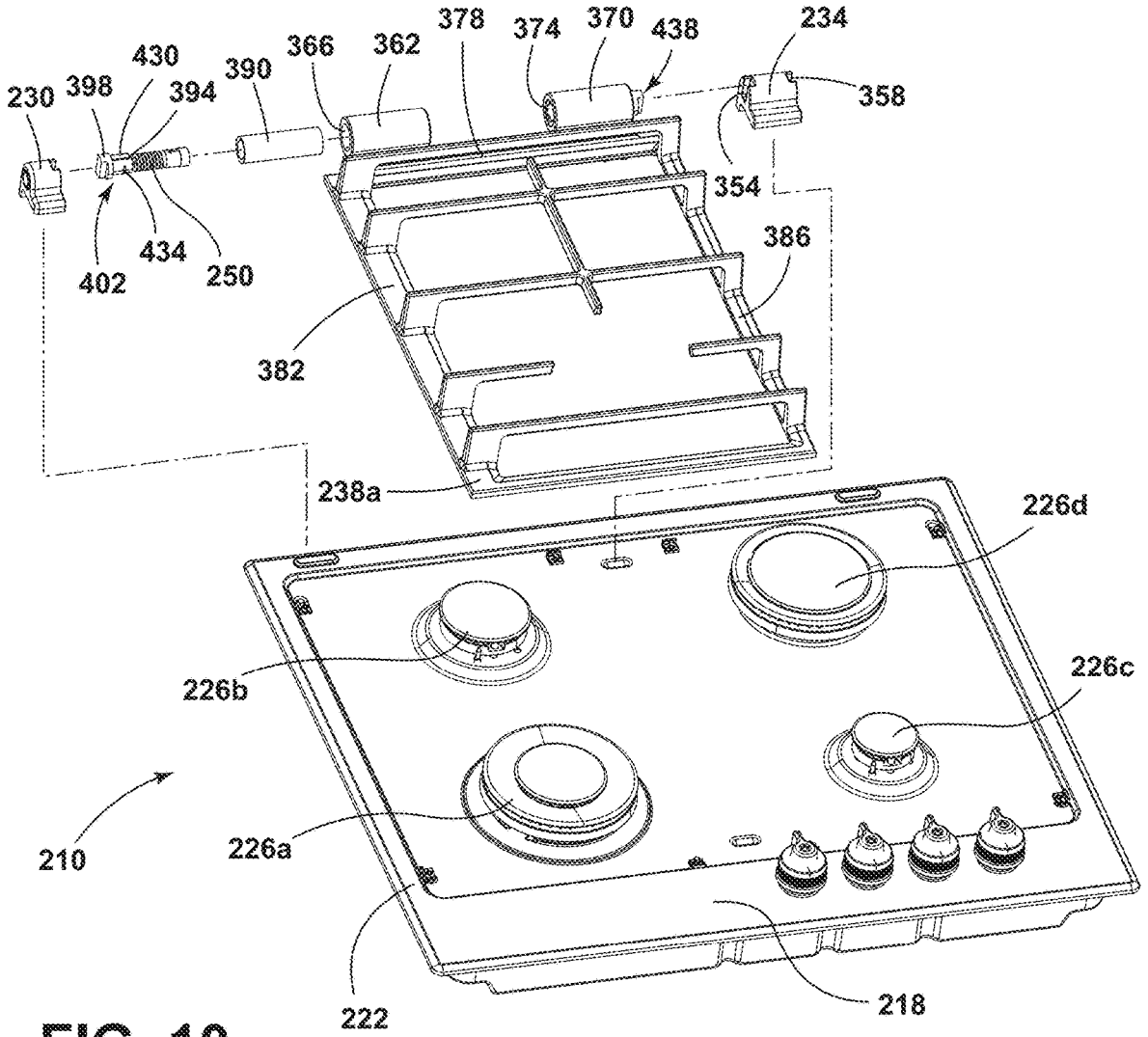
FIG. 10 is an exploded view of a cooktop with a grate having a pivot assembly and a biasing assembly.

Referring now to FIG. 10, the grate 238 may define a first receiving member 362 having a first receiving channel 366 and a second receiving member 370 having a second receiving channel 374. First and second receiving members 362, 370 may extend from a first end 378 of the grate 238. The first and second receiving members 362, 370 may be spaced-apart from one another such that the first receiving members 362 may be disposed proximate a first side edge 382 of the grate 238 and the second receiving member 370 may be disposed proximate a second side edge 386 of the grate 238. In various examples, a coupling member 390 may be disposed within the first receiving channel 366 of the first receiving member 362. The coupling member 390 may be configured as an elongated extruded member disposed within the first receiving channel 366. According to various aspects, the coupling member 390 may be configured to interlock with a pivot member 394.

In various examples, the pivot member 394 may be coupled between the first support base 230 and the first receiving member 362. The pivot member 394 may be directly coupled to the first support base 230, or alternatively, may be coupled to an interlocking base plate 398, which may be directly coupled to the first support base 230. According to various aspects, the pivot member 394 may be rotatable relative to the first support base 230. In this way, the pivot member 394 may be configured to guide rotation of the grate 238 as the grate 238 rotates between a raised position 242 and a lowered position 246. The pivot member 394 and the interlocking base plate 398 may form a pivot assembly 402 disposed between the first support base 230 and the first receiving member 362. In such examples, the interlocking base plate 398 may couple the pivot assembly 402 to the first support base 230 and the pivot member 394 may engage the coupling member 390.

Figure 10A:
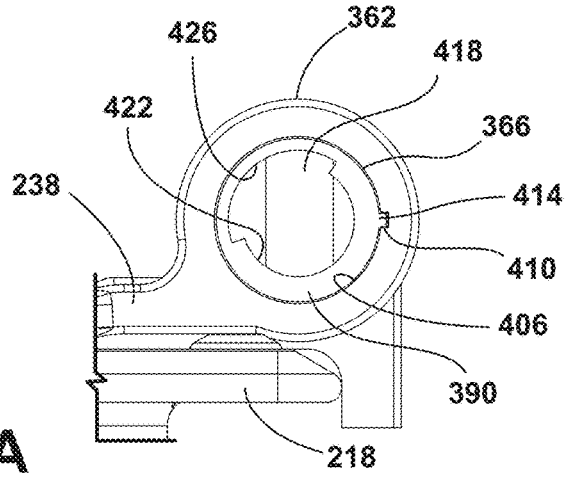
FIG. 10A is a side plan view of a coupling member within a receiving member of a grate.

Referring to FIGS. 10 and 10A, the coupling member 390 may define an interlocking fit with the first receiving member 362 in the first receiving channel 366. In various examples, an interior surface 406 of the first receiving member 362 may define an indent 410. In such examples, the coupling member 390 may be extruded with a protrusion 414. When assembled, the protrusion 414 of the coupling member 390 may be disposed within the indent 410 of the first receiving member 362. This configuration may be advantageous for preventing rotation of the coupling member 390 within the first receiving channel 366. In this way, the coupling member 390 may rotate with the grate 238. Additionally or alternatively, the coupling member 390 may define an inner channel 418 therein. An inner surface 422 of the coupling member 390 may define a cutout 426 forming an extension of the inner channel 418. Additionally or alternatively, the pivot member 394 of the pivot assembly 402 may define a coupling extension 430 extending from an outer surface 434 of the pivot member 394. The pivot member 394 may be at least partially received within the inner channel 418 of the coupling member 390. Stated differently, the pivot member 394 may be at least partially received within the first receiving channel 366 of the first receiving member 362.

The coupling extension 430 may be disposed within the cutout 426 of the coupling member 390. In this way, the coupling extension 430 may define an interlocking fit within the cutout 426. In this configuration, the pivot member 394 may rotate with the coupling member 390, and correspondingly with the grate 238. In examples where the pivot member 394 rotates with the coupling member 390, the pivot member 394 may rotate relative to the interlocking base plate 398. Alternatively, the coupling extension 430 may not be form fit within the cutout 426. In such examples, the pivot member 394 may not rotate or may minimally rotate with the coupling member 390. The pivot member 394 may engage the inner surface 422 within the cutout 426, to define the raised and lowered positions 242, 246 of the grate 238. In this way, the pivot member 394 may engage a first surface of the cutout 426 when the grate 238 is in the lowered position 246 and may engage an opposing surface of the cutout 426, when the grate 238 is in the raised position 242.

Figure 11:
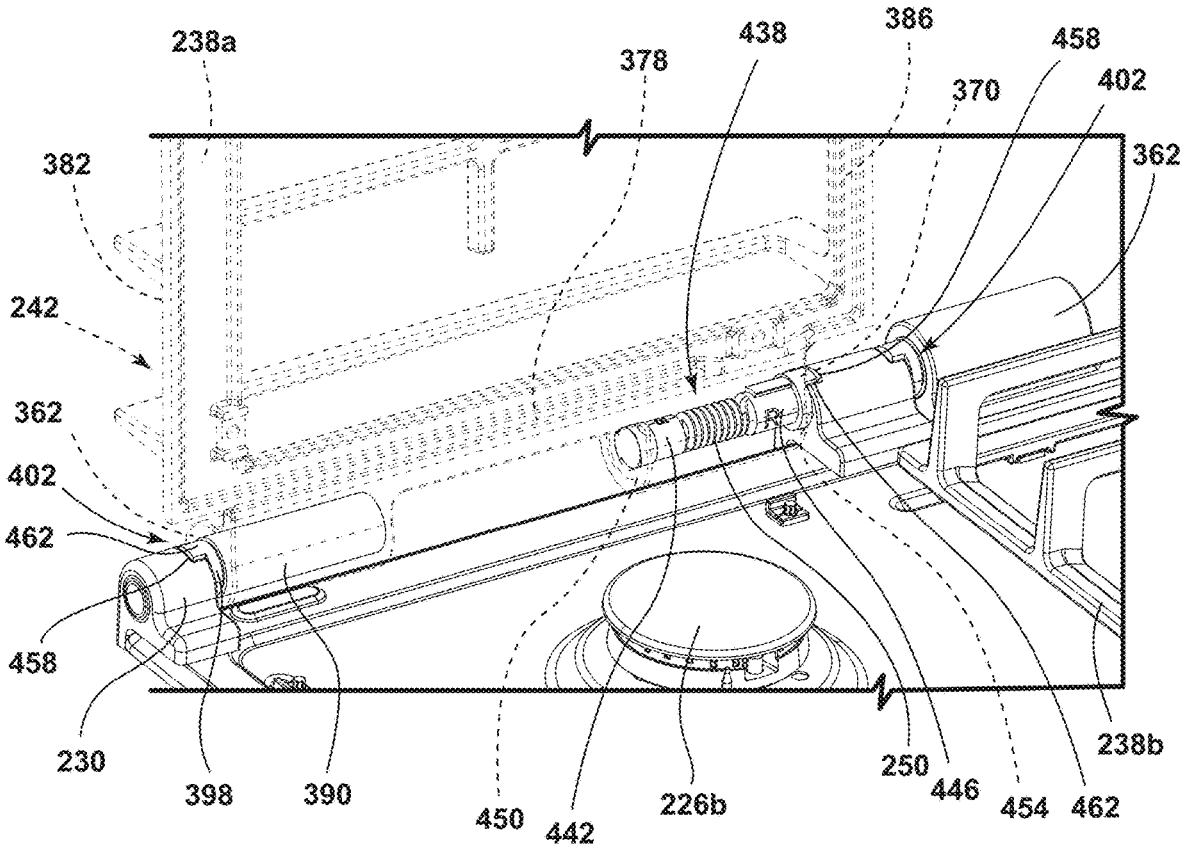
FIG. 11 is a perspective detail view of the support assembly and a grate.

Referring to FIG. 11, the cooktop 10 may include a biasing assembly 438 that includes a biasing member 250. The biasing assembly 438 may include a first housing 442, a second housing 446, and the biasing member 250 disposed between the first and second housings 442, 446. The biasing assembly 438 may be coupled to at least one of the first and second support bases 230, 234. As illustrated in FIG. 11, the pivot assembly 402 is coupled to the first support base 230 and the biasing assembly 438 is coupled to the second support base 234. However, it is contemplated that the pivot assembly 402 may be coupled to the second support base 234 and the biasing assembly 438 may be coupled to the first support base 230, without departing from the teachings herein.

In examples that include the first and second grates 238*a*, 238*b*, the first and second grates 238*a*, 238*b* may be coupled to first, second, and third support bases 320, 234, 338 and may be configured as mirror images of one another. As illustrated in FIG. 11, the biasing assembly 438 is received within the second receiving channel 374 of the second receiving member 370. The first housing 442 may be disposed proximate an inner end 450 of the second receiving channel 374 and the second housing 446 may be disposed proximate an outer end 454 of the second receiving channel 374. In this way, the biasing member 250 may extend along a substantial portion of the second receiving channel 374. The biasing assembly 438 stores potential energy by compressing the biasing member 250. The biasing member 250 may torsionally compress under rotation of the grate 238 towards the cooktop base surface 218 (e.g., in the lowered position 246), but may provide an upward biasing force on the grate 238. The biasing assembly 438 may be configured to bias the grate 238 toward the raised position 242. It may be advantageous for the biasing assembly 438 to bias the grate 238 toward the raised position 242 to allow for easier movement to the raised position 242. In this way, the biasing member 250 may be compressible under rotation of the grate 238 toward the lowered position 246. However, it is also contemplated that the biasing assembly 438 may bias the grate 238 toward the lowered position 246.

Figure 12:
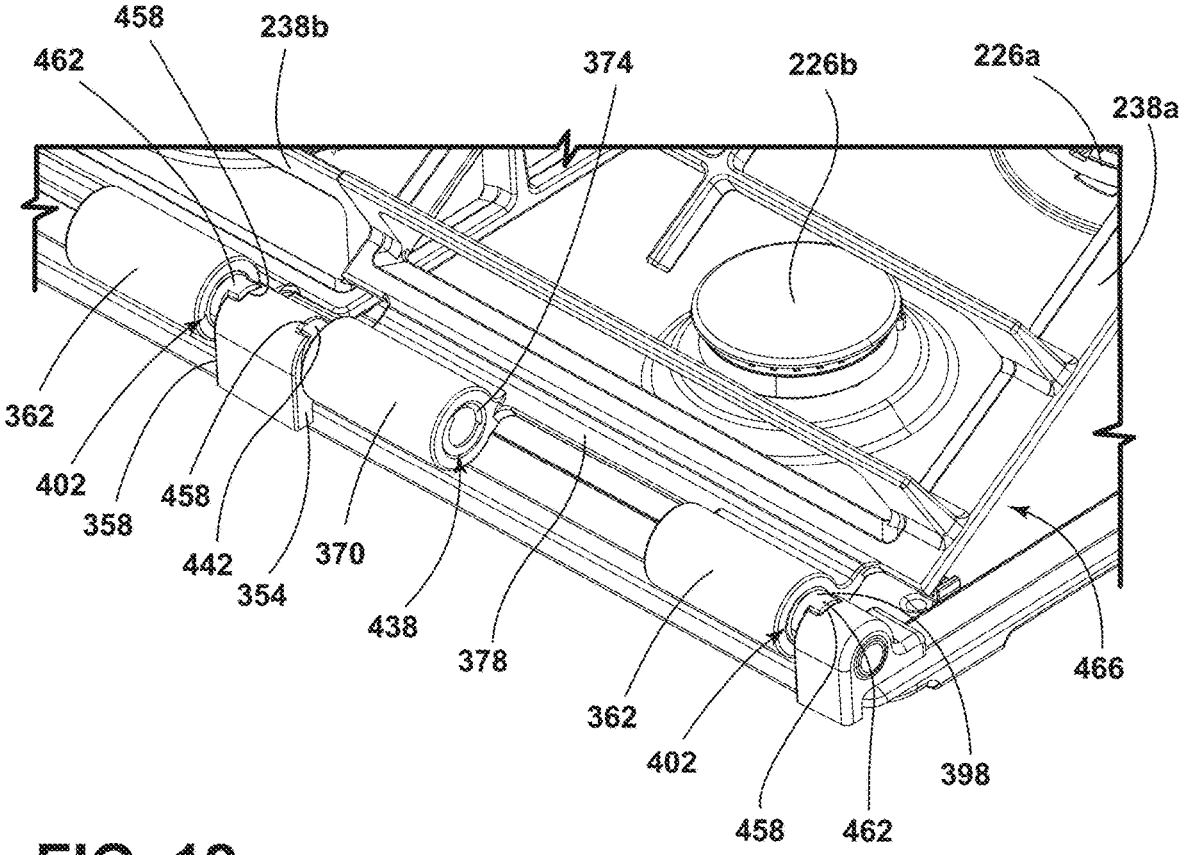
FIG. 12 is a perspective detail view of a portion of a grate in a rotated position about a support assembly.

Referring to FIGS. 11 and 12, the grate 238 may be coupled to the pivot assembly 402 and the biasing assembly 438. The pivot assembly 402 and the biasing assembly 438 may be substantially disposed within the first and second receiving members 362, 370, respectively, which may be advantageous for obscuring the pivot assembly 402 and the biasing assembly 438 from view of the user. This may be further advantageous for improving the aesthetics of the cooktop 310.

In various examples, each of the first and second support bases 230, 234 may each define a notch 458. The first housing 442 of the biasing assembly 438 and the interlocking base plate 398 of the pivot assembly 402 may each define a coupling protrusion 462. The coupling protrusions 462 are configured to be received by the notches 458. The coupling protrusions 462 may be slidably engaged in the notches 458 along direction 322. In this way, the grate 238 may be removed and re-assembled with the first and second support bases 230, 234. When in the raised position 242, the grate 238 may be lifted by the user along the direction 322 upward and away from the cooktop base surface 218 to disengage the grate 238 from the cooktop base surface 218. To re-assemble the grate 238, the coupling protrusions 462 may be aligned with the notches 458. The grate 238 may then be moved in a direction opposite of the direction 322 and the coupling protrusions 462 may be inserted into the notches 458. The grate 238 may then be rotated to the lowered position 246. It is contemplated that the grate 238 may be removed when in the fully raised position 242, but not when the grate 238 is in the lowered position 246 due to internal friction created by the biasing member 250.

Referring still to FIG. 12, the biasing assembly 438 may have the biasing force that at least partially counteracts the weight of the grate 338. The biasing force may be configured to not interfere with the positioning of the grate 338 in the lowered position 346 for use by the user. Additionally or alternatively, the biasing assembly 438 may be configured to retain the grate 238 in at least one intermediate position 466. The intermediate position 466 may be any position between the raised and lowered positions 242, 246. Stated differently, the grate 238 may be retained by the biasing assembly 438 at an angle less than a predetermined angle 330 of the fully raised position 242. The intermediate position 466 may be advantageous for accessing the cooktop base surface 218. The intermediate position 466 may also be advantageous for providing a "soft" movement of the grate 238 between the raised and lowered positions 242, 246.

Figure 13:
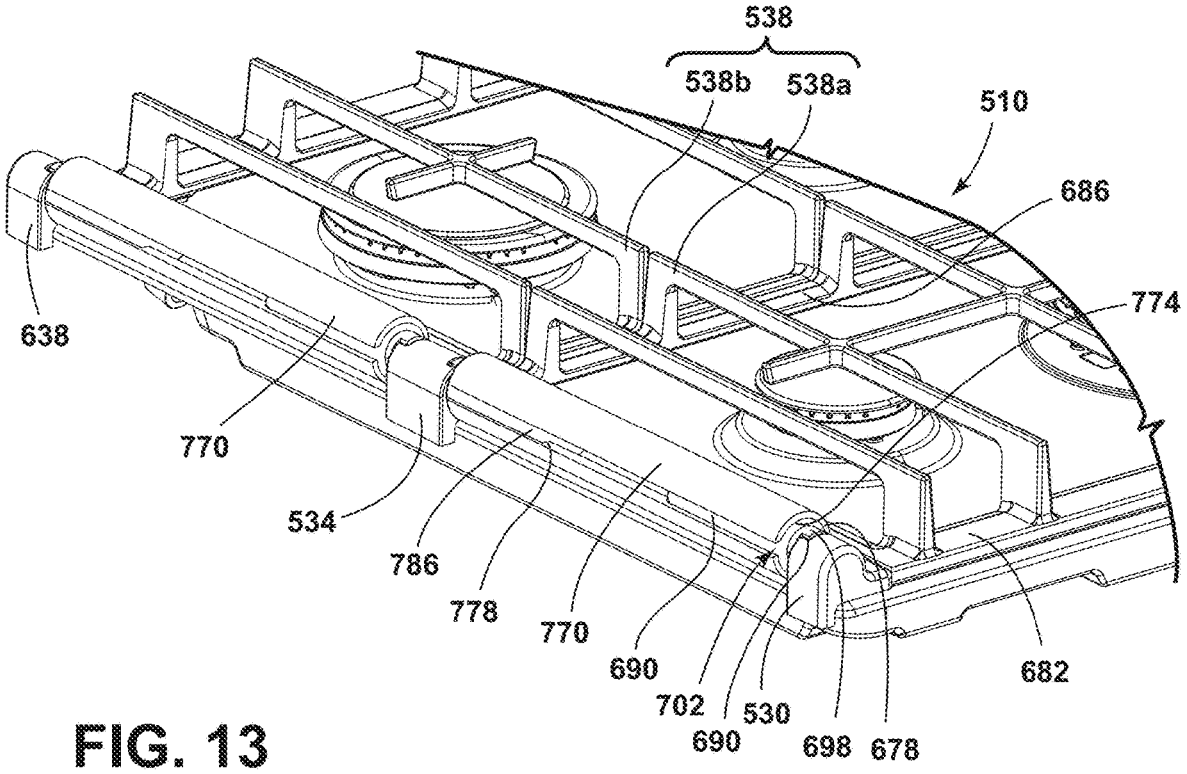
FIG. 13 is a partial rear perspective view of a cooktop with a grate having a pivot assembly and a biasing assembly.
Figure 13A:
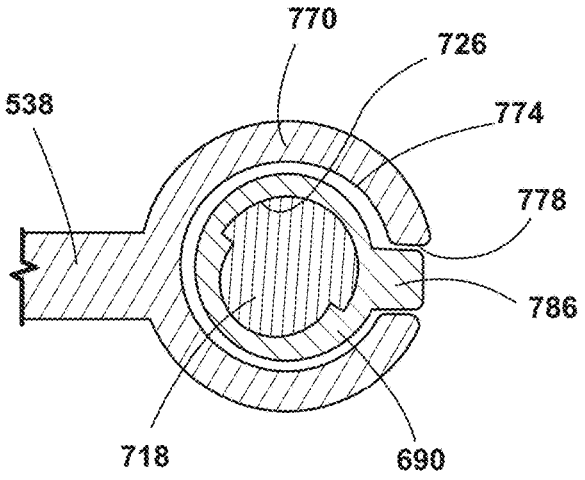
FIG. 13A is a side plan view of a coupling member within a receiving member of a grate.

Referring to FIGS. 13 and 13A, an additional and/or alternative configuration of the cooktop 510 is illustrated (with similar features indicated by similar numbers increased by 300). First, second, and third support bases 530, 534, 638 may be disposed proximate a rear edge of the cooktop 510. A grate 538, including first and second grates 538*a*, 538*b* may be rotatably coupled to the first, second, and third support bases 530, 534, 638. The grate 538 may include a receiving member 770 that defines a receiving channel 774 therein. The receiving member 770 may extend from a first end 678 of the grate 538 and engage two of the first, second, and third support bases 530, 534, 638. In various examples, the receiving member 770 may extend between a first side edge 682 and a second edge 686 of the grate 538. Additionally or alternatively, the receiving member 770 may extend an entire distance between the first and second side edges 682, 670 of the grate 538.

According to various aspects, a coupling member 690 may be disposed within the receiving channel 774. The coupling member 690 may extend an entire length of the receiving channel 774. Alternatively, two coupling members 690 may be disposed within the receiving channel proximate each of the first and second side edges 662, 670 of the grate 538. The two coupling members 690 may cumulatively extend the entire length of the receiving channel 774, or alternatively, may be spaced-apart from one another. The coupling member 690 may be configured as an elongated extruded member disposed within the receiving channel 774. The coupling member 690 may be configured to interlock with a pivot member 394 coupled to the first support base 530. The pivot member 694 may be coupled between the first support base 530 and the receiving member 770. In this way, a pivot assembly 702 may be disposed between the first support base 530 and the receiving member 770.

Referring still to FIGS. 13 and 13A, the coupling member 690 may define an interlocking fit with the receiving member 770. A slot 778 may be defined by the receiving member 770. As illustrated, the slot 778 is configured as two spaced-apart slots 778 extending inward from opposing edges 782 of the receiving member 770. It is also contemplated that the receiving member 770 may define a single slot 778 along an entire length thereof. The coupling member 770 may define an interlocking feature 786 that extends through the slot 778 to interlock the coupling member 770 with the grate 538. In examples with two slots 778, the coupling member 770 may define a corresponding number of interlocking features 786 to extend therethrough.

A biasing assembly 738 may be coupled to one of the opposing side edges 682, 686 and the pivot assembly 702 may be coupled to the other of the opposing side edges 682, 686. At least one of the biasing assembly 738 and the pivot assembly 702 may engage the coupling member 770. It is also contemplated that the pivot assembly 738 may not engage the coupling member 770. In such examples, the biasing assembly 738 may extend into the receiving channel 774 and be disposed adjacent to the coupling member 770. According to various aspects, the coupling member 690 may include an inner channel 718 that defines a cutout 726 forming an extension of an inner channel 718 thereof. At least one of the pivot member 698 and the biasing assembly 738 may include a coupling extension 690 configured to be disposed within the cutout 726 and engage the inner channel 718. In this way, one or both of the pivot member 698 and the biasing assembly 738 may form an interlocking fit with the coupling member 690.

Use of the presently disclosed device may provide for a variety of advantages. For example, the grate 38 may be disengaged from the cooktop 10 when in the raised position 42, but not the lowered position 46 or an intermediate position 266. Additionally, the biasing assembly 238 with the biasing member 50 may provide increased control when moving the grate 38 between the raised and lowered positions 42, 46. Further, the biasing member 50 and/or the biasing assembly 238 may retain the grate 38 in an intermediate position 266. Moreover, the biasing member 50 may bias the grate 38 toward the raised position 42 to provide easier movement of the grate 38 to the raised position 42. These and other advantages or benefits of using the presently disclosed device may also be realized and/or achieved.

According to at least one aspect of the present disclosure a cooktop or an appliance includes a cooktop base surface that defines an edge. A cooking burner is mounted on the cooktop basis surface. At least one support base is rigidly fixed to the cooktop base surface adjacent the edge. A grate is rotatably supported by the at least one support base and is rotated between raised and lowered positions to alternately cover and uncover the cooking burner. A biasing member is coupled to the at least one support base and exerts an upward biasing force on the grate.

According to another aspect of the present disclosure, at least one support base includes first and second support bases. A grate includes first and second mounting projections that define slots and are engageable over first and second mounting projection tabs that extend outwardly from first and second support bases, respectively.

According to another aspect of the present disclosure, an axle extends between and is rotatably coupled to the first and second support bases. The first and second mounting projection tabs are rotatably coupled with the first and second support bases by the axle.

According to still another aspect of the present disclosure, a biasing member is a spring and is compressible under rotation of a grate toward a lowered position.

According to another aspect of the present disclosure, a grate defines a first receiving member having a first receiving channel and a second receiving member having a second receiving channel.

According to yet another aspect of the present disclosure, a pivot member is coupled between at least one support base and a first receiving member.

According to another aspect of the present disclosure, a biasing member is at least partially disposed within a second receiving channel.

According to at least one aspect of the present disclosure, a cooktop for an appliance includes a cooktop base surface that defines an edge. A first support bases rigidly fixed with the cooktop base surface adjacent the edge. A pivot member is coupled to the first support base and a second support base is rigidly fixed with the cooktop base surface adjacent to the first support base. A biasing assembly includes a first housing, a second housing, and a biasing member disposed therebetween. The biasing assembly is coupled to the second support base. At least one grate is coupled to the pivot member and the biasing assembly. The at least one grate is rotatable between raised and lowered positions and biased toward the raised position by the biasing assembly.

According to another aspect, a pivot member is rotatable relative to the first support base and is configured to guide rotation of at least one grate as the at least one grate rotates between raised and lowered positions.

According to still another aspect, at least one grate includes a first grate coupled to a first side of a second support base and a second grate coupled to a second side of the second support base.

According to yet another aspect, at least one grate defines a first receiving member having a first channel and a second receiving number having a second channel. A pivot member is received within the first channel and a biasing assembly is received in the second channel.

According to still another aspect, a first housing is disposed proximate an inner end of a second channel and a second housing is disposed proximate an outer end of the second channel.

According to still another aspect, a coupling member is disposed within a first channel and a pivot member engages the coupling member.

According to another aspect, a biasing member is compressible under rotation of at least one grate toward a lowered position.

According to another aspect, a biasing assembly retains at least one grate in at least one intermediate position between raised and lowered positions.

According to at least one aspect of the present disclosure, a cooktop assembly includes a cooktop base surface that defines an edge. A grate is operably coupled to the cooktop base surface. The grate defines a first receiving member that has a first channel and a second receiving member that has a second channel. A first support base is coupled to the cooktop base surface proximate the edge. A pivot member is coupled to the first support base and at least partially received within the first channel. A second support base is coupled to the cooktop base surface proximate the edge. A biasing assembly is coupled to the second support base and received within the second channel and biases the grate toward a raised position.

According to another aspect, a biasing assembly includes a first housing, second housing, and a biasing member disposed therebetween.

According to yet another aspect, a biasing member is a spring and is compressible under rotation of a grate toward a lowered position.

According to another aspect, a coupling member is disposed within a first channel and configured to interlock with a pivot member.

According to still another aspect, a biasing assembly retains a grate in at least one intermediate position between raised and lowered positions.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooktop for an appliance, comprising:

a cooktop base surface defining an edge;

a cooking burner mounted on the cooktop base surface;

at least one support base rigidly fixed with the cooktop base surface adjacent the edge;

a grate rotatably supported by the at least one support base to be rotated between a raised position and a lowered position to alternately cover and uncover the cooking burner, the grate defining at least one receiving member extending from an end thereof; and a biasing member coupled to the at least one support base and at least partially disposed within the at least one receiving member, the biasing member exerting an upward biasing force on the grate.

2. The cooktop of claim 1, wherein the biasing member is a spring and is compressible under rotation of the grate toward the lowered position.

3. The cooktop of claim 1, wherein the at least one receiving member includes a first receiving member having a first receiving channel and a second receiving member having a second receiving channel.

4. The cooktop of claim 3, further comprising:

a pivot member coupled between the at least one support base and the first receiving member.

5. The cooktop of claim 3, wherein the biasing member is at least partially disposed within the second receiving channel.

6. The cooktop of claim 1, wherein the at least one support base includes a first support base and a second support base, the cooktop further comprising:

a biasing assembly coupled to the first support base, the biasing assembly including the biasing member disposed between a first housing and a second housing; and a pivot assembly coupled to the second support base and configured to guide rotation of the grate, the pivot assembly including a pivot member coupled to a second biasing member.

7. The cooktop of claim 6, wherein the at least one receiving member includes a first receiving member having a first receiving channel and a second receiving member having a second receiving channel, and wherein the biasing assembly is disposed at least partially within the first receiving channel and the pivot assembly is disposed at least partially within the second receiving channel.

8. A cooktop for an appliance, comprising:

a cooktop base surface defining an edge;

a first support base rigidly fixed with the cooktop base surface adjacent the edge;

a pivot member coupled to the first support base;

a second support base rigidly fixed with the cooktop base surface adjacent the first support base;

a biasing assembly including a first housing, a second housing, and a biasing member disposed therebetween, wherein the biasing assembly is coupled to the second support base; and at least one grate coupled to the pivot member and the biasing assembly, wherein the at least one grate is rotatable between raised and lowered positions and biased toward the raised position by the biasing assembly.

9. The cooktop of claim 8, wherein the pivot member is rotatable relative to the first support base and configured to guide rotation of the at least one grate as the at least one grate rotates between the raised and lowered positions.

10. The cooktop of claim 8, wherein the at least one grate includes a first grate coupled to a first side of the second support base and a second grate coupled to a second side of the second support base.

11. The cooktop of claim 8, wherein the at least one grate defines a first receiving member having a first channel and a second receiving member having a second channel, and wherein the pivot member is received in the first channel and the biasing assembly is received in the second channel.

12. The cooktop of claim 11, wherein the first housing is disposed proximate an inner end of the second channel and the second housing is disposed proximate an outer end of the second channel.

13. The cooktop of claim 11, further comprising:

a coupling member disposed in the first channel, wherein the pivot member engages the coupling member.

14. The cooktop of claim 8, wherein the biasing member is compressible under rotation of the at least one grate toward the lowered position.

15. The cooktop of claim 8, wherein the biasing assembly retains the at least one grate in at least one intermediate position between the raised and lowered positions.

16. A cooktop assembly, comprising:

a cooktop base surface defining an edge;

a grate operably coupled to the cooktop base surface, wherein the grate defines a first receiving member having a first channel and a second receiving member having a second channel;

a first support base coupled to the cooktop base surface proximate the edge;

a pivot member coupled to the first support base and at least partially received within the first receiving channel;

a second support base coupled to the cooktop base surface proximate the edge; and a biasing assembly including a biasing member disposed between a first housing and a second housing, the biasing assembly coupled to the second support base and biasing the grate toward a raised position, each of the first housing and the biasing member at least partially received within the second receiving channel.

17. The cooktop assembly of claim 16, wherein the biasing member is a spring and is compressible under rotation of the grate toward the lowered position.

18. The cooktop assembly of claim 16, further comprising:

a coupling member disposed within the first channel and configured to interlock with the pivot member.

19. The cooktop assembly of claim 16, wherein the biasing assembly retains the grate in at least one intermediate position between raised and lowered positions.

20. The cooktop assembly of claim 16, wherein the biasing assembly is spaced from the first support base.

* * * * *